US008916026B2

(12) United States Patent
Jehn-Rendu et al.

(10) Patent No.: US 8,916,026 B2
(45) Date of Patent: Dec. 23, 2014

(54) MANUFACTURE OF CELLULOSIC PULP SHEETS

(75) Inventors: Christian Jehn-Rendu, Shanghai (CN); Joachim Hege, Kleinniedesheim (DE); Detlef Kannengieβer, Zwingenberg (DE)

(73) Assignee: BASF SE, Ludwigshafen (DE)

( * ) Notice: Subject to any disclaimer, the term of this patent is extended or adjusted under 35 U.S.C. 154(b) by 0 days.

(21) Appl. No.: 13/885,760

(22) PCT Filed: Nov. 14, 2011

(86) PCT No.: PCT/EP2011/070059

§ 371 (c)(1), (2), (4) Date: Aug. 1, 2013

(87) PCT Pub. No.: WO2012/065951

PCT Pub. Date: May 24, 2012

(65) Prior Publication Data

US 2013/0306257 A1 Nov. 21, 2013

Related U.S. Application Data

(60) Provisional application No. 61/413,997, filed on Nov. 16, 2010.

(30) Foreign Application Priority Data

Nov. 16, 2010 (EP) ..... 10191283

(51) Int. Cl.
*D21H 21/10* (2006.01)
*D21H 17/37* (2006.01)

(52) U.S. Cl.
CPC ..... *D21H 17/375* (2013.01); *D21H 21/10* (2013.01); *D21H 17/37* (2013.01)
USPC ..... 162/158; 162/168.3

(58) Field of Classification Search
USPC ..... 162/158, 168.3
See application file for complete search history.

(56) References Cited

U.S. PATENT DOCUMENTS 4,421,602 A 12/1983 Brunnmueller et al.
4,772,359 A 9/1988 Linhart et al.

(Continued)

FOREIGN PATENT DOCUMENTS

CN 101014741 8/2007
CN 1795304 6/2008

(Continued)

OTHER PUBLICATIONS

International Search Report Issued Feb. 22, 2012 in PCT/EP11/70059 Filed Nov. 14, 2011.

(Continued)

*Primary Examiner* — Anthony Calandra
(74) *Attorney, Agent, or Firm* — Oblon, Spivak, McClelland, Maier & Neustadt, L.L.P.

(57) ABSTRACT

A pulp making process in which fibrous cellulosic material is pulped to form an aqueous suspension of cellulosic material, the suspension is drained through a screen to form a pulp sheet and that the pulp sheet is dried to form a dry market pulp, in which a water soluble cationic polymer is added to the suspension as the sole drainage aid wherein the water-soluble cationic polymer is either, i) a copolymer comprising (a) between 1 and 70 mole % (meth)acrylamide and (b) between 30 and 99 mole % (meth)acryloyloxyethyl-trimethyl ammonium chloride with an intrinsic viscosity between 5 and 9 dl/g; or ii) a hydrolysed homopolymer of vinylformamide comprising between 1 and 100 mole % vinyl amine units and having a K value of between 45 and 240. The process of the invention provides improved drainage time and solids content of the dewatered pulp.

9 Claims, 2 Drawing Sheets

(56) References Cited

U.S. PATENT DOCUMENTS

Figure 1:
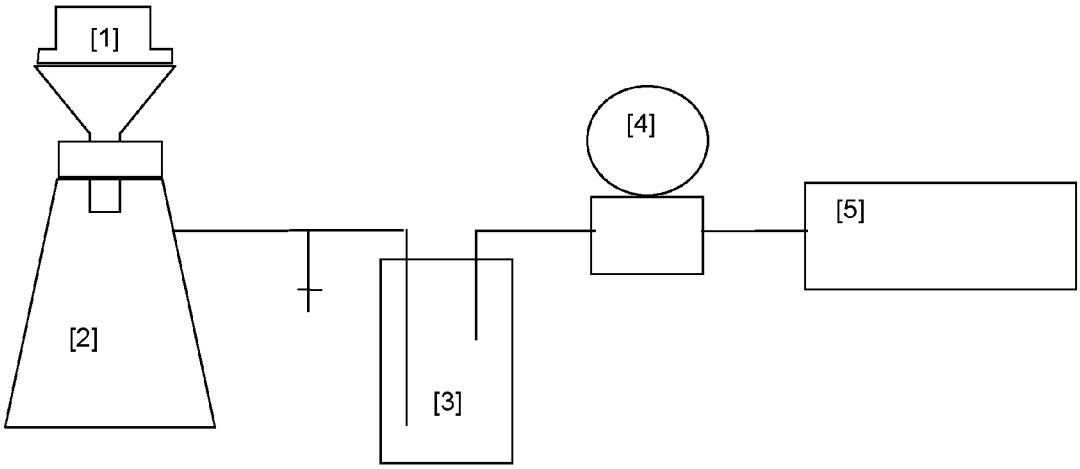

| | | | |
|---|---|---|---|
| 5,145,559 | A | 9/1992 | Auhorn et al. |
| 5,180,473 | A | 1/1993 | Akune et al. |
| 2003/0083204 | A1 | 5/2003 | Chatterji et al. |
| 2005/0061461 | A1 | 3/2005 | Linhart et al. |
| 2006/0162883 | A1 | 7/2006 | Champ et al. |
| 2008/0000601 | A1 | 1/2008 | Ledue et al. |

FOREIGN PATENT DOCUMENTS

| | | |
|---|---|---|
| DE | 102 37 911 | 2/2004 |
| EP | 0 102 760 | 3/1984 |
| EP | 0 126 528 | 11/1984 |
| EP | 0 150 933 | 8/1985 |
| EP | 0 231 901 | 8/1987 |
| EP | 0 249 891 | 12/1987 |
| EP | 0 335 576 | 10/1989 |
| EP | 0 362 770 | 4/1990 |
| EP | 0 438 707 | 7/1991 |
| EP | 0 438 755 | 7/1991 |
| JP | 59-87097 | 5/1984 |
| JP | 59 87097 | 5/1984 |
| WO | 00 27893 | 5/2000 |
| WO | WO 00/27893 A1 | 5/2000 |
| WO | 02 083743 | 10/2002 |
| WO | 02 088468 | 11/2002 |
| WO | WO 02/088468 | 11/2002 |
| WO | WO 2004/092482 | 10/2004 |
| WO | 2008 036031 | 3/2008 |

OTHER PUBLICATIONS

International Preliminary Report on Patentability and Written Opinion issued May 30, 2013 in Application No. PCT/EP2011/070059 (English Translation).

Chinese Office Action mailed Aug. 21, 2014 (w/English translation).

Pulp Machine Dosed at 1000 g polymer /tonne dry suspension

MANUFACTURE OF CELLULOSIC PULP SHEETS

The present invention relates to improvements in the manufacture of cellulosic pulp sheets.

Cellulosic pulp is generally manufactured in pulp mills or integrated mills that serve as both pulp and paper mills. Normally wood and/or other fibrous cellulosic feedstock is broken up to form a cellulosic pulp, which is usually subjected to various washing and filtering stages. Additionally the pulp may also be bleached. In an integrated mill it is unnecessary to dry the pulp at any stage and instead may be diluted directly to form a thin stock for the papermaking process.

Pulp mills that are not integrated into paper mills also manufacture the pulp from wood or fibrous cellulosic material which is then converted to a dry product generally known as "dry market pulp". This dry pulp may then be used as a feedstock at a paper mill to make the aqueous cellulosic suspension used in a papermaking process.

The pulping stages in a pulp mill can generally be similar to the pulping stages in an integrated mill except that at the end of the washing stages it is necessary to drain the pulp and then thermally dry it. This drainage may often be conducted on a machine known as a "lap pulp machine".

Japanese patent publication 59-087097 describes the vacuum dehydration of sludge containing crushed matter of pulp containing cellulosic material using generally a cationic macromolecular coagulant, for instance cationically modified polyacrylamide, chitosan, and polyvinyl imidazoline.

EP 335576 sets out to improve the drainage in a process for making dry market pulp. It is indicated that previously the addition of sophisticated dewatering and retention systems in pulp mills had been found unsuccessful due to reductions in drainage and the increase in the amount of thermal drying would be required produce the dried pulp sheets. The inventors of that disclosure describe a pulp making process in which a water-soluble cationic polymer is added to the suspension of cellulosic material before one or more shear stages and then after that shear stage the addition of an inorganic material such as bentonite. The document exemplifies the use of a copolymer of 70% by weight acrylamide and 30% by weight (13.6 mole %) dimethyl amino ethyl acrylate quaternised with methyl chloride of intrinsic viscosity 10 dl/g in conjunction with bentonite. Also exemplified are polymers with the same monomer units and cationicity but with intrinsic viscosities of 8 to 10 dl/g and 6 to 8 dl/g respectively and the test work indicates improved dewatering time when these two polymers are used in conjunction with bentonite by comparison to the use of the polymers alone.

More recently WO 02/088468 describes a method for the production of shock resistant fibrous moulded bodies. The process involves the addition of a modified starch to an aqueous mass of fibrous material before it is placed into a mould. The modified starch is prepared by digesting starch in the presence of at least one cationic polymer.

WO 2008/036031 relates to a method for preparing pulp sheets involving treating an aqueous suspension of bleached pulp derived from an alkaline pulping process involving dewatering and drying the suspension, in which the pH of the suspension is between 6.5 and 12. The use of cationic starch or cationic polyacrylamide is described for the dewatering.

However, there is a desire to further improve the drainage rate and dryness of the resulting dewatered pulp sheets.

The objective of the present invention has been achieved by employing one of two specifically defined cationic polymers as the sole drainage agent. The first of these polymers is a copolymer of (meth)acrylamide and (meth)acryloyloxy trimethyl ammonium chloride having a molar cationic content of between 30 and 99% and exhibiting an intrinsic viscosity of between 5 and 9 dl/g. The second of these polymers is the homopolymer of vinylformamide which has been hydrolysed to provide between 1 and 100 mole % vinyl amine units based on the total polymer and in which the polymer has a K value of between 45 and 240.

Thus the invention relates to a pulp making process in which fibrous cellulosic material is pulped to form an aqueous suspension of cellulosic material, the suspension is drained through a screen to form a pulp sheet and that the pulp sheet is dried to form a dry market pulp, in which a water soluble cationic polymer is added to the suspension as the sole drainage aid wherein the water-soluble cationic polymer is either, i) a copolymer comprising (a) between 1 and 70 mole % (meth)acrylamide and (b) between 30 and 99 mole % (meth)acryloyloxyethyl-trimethyl ammonium chloride with an intrinsic viscosity between 5 and 9 dl/g; or ii) a hydrolysed homopolymer of N-vinylformamide comprising between 1 and 100 mole % vinyl amine units and having a K value of between 45 and 240.

Particularly desired copolymers according to category (i) of the invention are such copolymers of acrylamide with acryloyloxyethyltrimethyl ammonium chloride.

One desirable copolymer according to the invention comprises (a) between 30 and 70 mole %, preferably between 50 and 70 mole % (meth)acrylamide, preferably acrylamide, and (b) between 30 and 70 mole %, preferably between 30 and 50 mole %, (meth)acryloyloxyethyltrimethyl ammonium chloride, preferably acryloyloxyethyltrimethyl ammonium chloride. These polymers must have intrinsic viscosities within the range of 5 and 9 dl/g.

A more desired copolymer of category (i) according to the present invention may have intrinsic viscosities within the range of 6 and 8 dl/g, including the aforementioned desired and preferred copolymers.

Intrinsic viscosity of polymers may be determined by preparing an aqueous solution of the polymer (0.5-1% w/w) based on the active content of the polymer. 2 g of this 0.5-1% polymer solution is diluted to 100 ml in a volumetric flask with 50 ml of 2M sodium chloride solution that is buffered to pH 7.0 (using 1.56 g sodium dihydrogen phosphate and 32.26 g disodium hydrogen phosphate per liter of deionised water) and the whole is diluted to the 100 ml mark with deionised water. The intrinsic viscosity of the polymers are measured using a Number 1 suspended level viscometer at 25° C. in 1M buffered salt solution.

The copolymers according to category (i) may be prepared by polymerising the respective monomers employing free radical initiators to initiate polymerisation. The initiators may, for instance, be redox initiator couples, in which radicals are generated by admixing with the monomer a redox couple which is a reducing agent and an oxidising agent. Typically redox initiators include a reducing agent such as sodium sulphite, sulphur dioxide and an oxidising compound such as ammonium persulphate or a suitable peroxy compound, such as tertiary butyl hydroperoxide etc. It is also conventional practice to use the redox system either alone or in combination with other initiator systems a thermal initiator, which would include any suitable initiator compound that releases radicals at an elevated temperature. Thermal initiators may include any suitable initiator compound that releases radicals at an elevated temperature, for instance azo compounds, such as azobisisobutyronitrile (AZDN), 4,4'-azobis-(4-cyanovalereic acid) (ACVA) etc. Other initiator systems include photo and radiation induced initiator systems, which require exposure to radiation to release radicals thereby effecting polymerisation. Other initiator systems are well known and well documented in the literature.

Desirably these copolymers may be prepared by reverse phase emulsion polymerisation, optionally followed by dehydration under reduced pressure and temperature and often referred to as azeotropic dehydration to form a dispersion of polymer particles in oil. Alternatively the polymer may be provided in the form of beads by reverse phase suspension polymerisation, or as a powder by aqueous solution polymerisation followed by comminution, drying and then grinding. The polymers may be produced as beads by suspension polymerisation or as a water-in-oil emulsion or dispersion by water-in-oil emulsion polymerisation, for example according to a process defined by EP-A-150933, EP-A-102760 or EP-A-126528.

Desirably, the hydrolysed homopolymer of N-vinyl formamide according to category (ii) of the invention has a degree of hydrolysis between 5 and 30 mole %, i.e. comprising vinyl amine units within this range.

The polymers of category (ii), including the aforementioned desired polymers, must have a K value between 45 and 240. More desirably the polymers of this category may have a K value of between 100 and 180, especially between 120 and 160.

The K value of the polymers are determined through the Fikentscher, CelluloseChemie, Band 13, 58-64 and 71-74 (1932) at a temperature of 25° C. in a 5 w % sodium chloride solution at a pH of 7 and a polymer concentration of 0.5%. (thus K=k*1000)

The polymers are obtainable, for example, by hydrolysis of homopolymers of N-vinylformamide. The polymers have, for example, a charge density of from 0.5 to 5.0, preferably from 1.5 to 3.5, meq/g. Polymers containing vinylamine units are known from the prior art, cf. in particular EP-A-0 438 755, page 3, line 15 to page 4, line 20, U.S. Pat. No. 4,421,602 and EP-A-0 231 901. The polymers are obtainable by homopolymerization of N-vinylformamide.

The polymerization of the N-vinylformamide is usually carried out in the presence of free radical polymerization initiators. The polymers can be polymerized by all known methods; for example, they may be obtained by solution polymerization in water, alcohols, ethers or dimethylformamide or in mixtures of different solvents, by precipitation polymerization, inverse suspension polymerization (polymerization of an emulsion of a monomer-containing aqueous phase in an oil phase) and polymerization of a water-inwater emulsion, for example in which an aqueous monomer solution is dissolved or emulsified in an aqueous phase and polymerized with formation of an aqueous dispersion of a water-soluble polymer, as described, for example, in WO 00/27893.

After the polymerization, the polymers which contain polymerized units of N-vinylformamide are fully or partially hydrolyzed to the degree specified above. The degree of hydrolysis corresponds to the content of vinylamine groups, in mol %, in the polymers. The hydrolysis is preferably carried out in the presence of an acid or of a base. However, the polymers can also be hydrolyzed enzymatically. In the hydrolysis with acids (for example mineral acids, such as sulfuric acid, hydrochloric acid or phosphoric acid, carboxylic acids, such as formic acid or acetic acid, or sulfonic acids or phosphonic acids), the corresponding ammonium salts of the polymers form, whereas, in the hydrolysis with bases, the vinylamine units of the polymers are present in the form of the free bases. The vinylamine units of the polymers can, if appropriate, be modified by converting them in a known manner into the quaternization products, for example by reacting the polymers with dimethyl sulfate. For example, the partially hydrolyzed homopolymers of N-vinylformamide, disclosed in U.S. Pat. No. 4,421,602, can be used as retention aids. The degree of hydrolysis of the polymerized N-vinylformamide units may be from 1 to 100%.

The cellulosic suspension used for making the pulp in the present invention may be made by conventional methods, for instance from wood or other feedstock. Deinked waste paper or board may be used to provide some of it. For instance the wood may be debarked and then subjected to grinding, chemical or heat pulping techniques, for instance to make a mechanical pulp, a thermomechanical pulp or a chemical pulp. The fibre may be bleached, for instance by using a conventional bleaching process, such as employing magnesium bisulphite or hydrosulphite. The pulp may have been washed and drained and rewashed with water or other aqueous wash liquor prior to reaching the final drainage stage on the pulp making machine. The dried market pulp is generally free or substantially free of filler, but filler can be included if desired.

The aqueous suspension of cellulosic material will generally be at a concentration of at least 1% by weight of solids based on the total weight of suspension. Often it will be at least 1.5% and may be as much as 2% or 3% or more. It may be desirable to prepare the aqueous suspension by combining the cellulosic fibres with warm water, for instance at temperatures of greater than 40° C. and possibly as high as 95° C. Generally, however, the temperature will be at least 50 or 60° C. and up to 80° C.

Typically the aqueous suspension of cellulose of material may, for instance, be pumped and dewatered on a metal mesh known as a machine wire. When the suspension flows onto the wire the cellulosic fibres form a sheet, which is sometimes referred to as a mat, and the aqueous liquid passes through the wire, often referred to as white water. This white water may be recycled and used in the formation of the aqueous suspension. It may be desirable to include a defoamer in the white water to prevent any undesirable or excessive foam production. Normally the cellulosic sheet which forms on the wire may have a thickness of at least 5 mm and for instance be as much as 5 cm. Typically the sheet will have a thickness of at least 1 cm or a least 2 cm and up to 4 cm, for instance around 3 cm.

The polymers employed according to the present invention may be added in any suitable amount, for instance at least 0.01% (i.e. 100 g of polymer per tonne of dried aqueous cellulosic suspension). Often the dose of polymer will be at least 0.02%, for instance at least 0.025% or even at least 0.03%, and frequently may be at least 0.04% or at least 0.05%. Typical doses may be up to 0.1% and may be as high as 0.15% or even to 0.2% or 0.3% or more.

It may be desirable to add polymer to the aqueous cellulosic suspension shortly before the drainage stage. However, it may also be desirable to add the polymer further back in the system, for instance before one or more of the pumping stages. Nevertheless, it is normally desirable to allow sufficient time for the polymer to bring about flocculation of the cellulosic suspension. A suitable point of addition may often be shortly before or shortly after the final pumping stage prior to dewatering on the wire.

The polymer may suitably be added in the form of an aqueous solution. Therefore if the polymer is in the form of a solid, for instance as a dry powder or bead, the polymer will first be dissolved into water, to form an aqueous solution of the polymer, before being dosed into the aqueous cellulosic suspension. The polymer may be dissolved in any conventional makeup equipment, such as described in the patents and literature.

When the polymer is in the form of a reverse phase liquid product, for instance as a reverse-phase emulsion or reverse-phase dispersion, the reverse-phase product will normally be inverted into water to enable the dispersed phase polymer to dissolve and thereby form an aqueous solution. In some cases where the reverse-phase product contains self inverting surfactants the reverse-phase product may simply be mixed with water to allow inversion and dissolution. For other reverse-phase liquid products it may be desirable to add inverting surfactants while mixing the reverse-phase product with water. The reverse-phase liquid products may be inverted using conventional techniques and conventional equipment described in the literature and patents.

Alternatively it may be desirable to add the polymer in other forms, for instance as a dry powder or in forms other than an aqueous solution.

The copolymer of (meth)acrylamide and (meth)acryloyloxy ethyl trimethyl ammonium chloride of category (i) or the hydrolysed polyvinyl formamide polymer of category (ii) may also be in the form of an aqueous dispersion, frequently referred to as a "water in water emulsion" or "water in water dispersion". Normally the product will be combined with water to enable the polymer contained in the aqueous dispersion to dissolve and form an aqueous solution. Nevertheless it may be desirable to add the aqueous dispersion directly to the aqueous cellulosic suspension.

Preferably the polymer will be added to the aqueous cellulosic suspension in the form of an aqueous solution. Typically the aqueous polymer solution will have a concentration of at least 0.1% by weight of dry polymer on the total weight of solution. Often the aqueous solution of polymer will have a concentration of at least 0.2% and in some cases up to 0.5% or more, for instance up to 1.0% or 1.5%.

The productivity of the fibre sheet formation will normally depend on the dewatering speed and the length of the wire. In order to further improve the dewatering speed it may be desirable to add warm water, for instance at temperatures of between 50 or 60° C. and up to 80 or 90 or even 100° C. It may alternatively be desirable to add steam in place of the warm water. In some cases it may be found that the addition of warm water or steam during the fibre sheet formation will reduce water surface tension. By removing more water as the sheet is forming on the machine wire the dewatering may be improved in the press section. The press section may contain one or more devices for squeezing residual water from the cellulosic sheet. Typically these devices may include for instance a Kombipress and/or a schuhpress. Depending upon the particular devices in the press section the cellulosic sheet may reach a solids content of at least 40% and up to 60% or more.

Once the fibre sheet has passed from the press section it can be dried, for instance with the assistance of the warm air. Generally the dried cellulosic sheet may have a solids content of at least 80% or 85% and as much as 90% or 95% by weight. Desirably at the end of the drying section the cellulosic sheet will be in the form of a dry pulp sheet. This may desirably be cut into pieces, for instance having a size of between 0.5 square meters and two square meters, often around one square meter.

It will usually be desirable to produce pulp sheets with a basis weight in excess of 800 g/m$^2$ and for instance up to 1000 g/m$^2$ or up to 1100 g/m$^2$ or more.

Pulp machines will often run at a speed of at least 20 m/minute and usually at least 40 m/minute. The machine speed may be as high as 600 m/minute but usually will be up to 450 or 500 m/minute. Typically the pulp machines may operate at speeds of between 50 and 300 m/minute.

The invention is illustrated in more detail by reference to the following, non-limiting examples.

EXAMPLES

The dosages in the different examples are based on the active polymer substances on dry cellulosic fibrous material.

The K value of the polymers are determined through the Fikentscher, Cellulose-Chemie, Band 13, 58-64 and 71-74 (1932) at a temperature of 25° C. in a 5 w % sodium chloride solution at a pH of 7 and a polymer concentration of 0.5%. (thus K=k*1000)

The drainage time under reduced pressure and the dryness of the cellulosic fibers pad are determined in accordance with the following vacuum test method:

A 1 liter glass beaker was filled with 0.5 liter of a 1 to 3.5% by weight suspension of 100% bleached beech sulfite fibers or bleached spruce sulfite fibers.

The fiber suspension is then stirred at 1000 rpm with a mechanical marine propeller stirrer and the polymer is added for a contact time of 10 seconds followed, if this is the case, by the bentonite for 5 seconds.

Then, the stirrer is stopped and simultaneously a stopwatch is started and the fibers dispersion is being drawn off rapidly through a wetted paper filter (Whatmann P 541) with the aid of reduced pressure avoiding turbulence (see equipment description drawing shown in FIG. 1).

The equipment of FIG. 1 comprises a Hartley funnel (1), which is placed on a Buchner flask (2). A vacuum pump (5) is connected through a vacuum gauge (4) and a water trap (3) to the flask.

When the reduced pressure reaches a minimum, the pressure (P1) is and the drainage time (t1) are measured.

After a minute, the increased pressure (P2) is measured again.

The reduced pressure is removed and the wet fiber sheet is taken from the wire and weighed (weight G1).

Subsequently the fiber sheet is dried to constant mass at 105° C. and weighed again (weight G2).

The solids content in % and hence the drainage performance is given by (G1−G2)/G2*100.

Product Descriptions:

Polymer A: Acrylamide:acryloyloxyethyltrimethylammonium chloride (80.8:19.2 weight % and 92:8 mole %), intrinsic viscosity of 6.4 dl/g.

Polymer B: Acrylamide:acryloyloxyethyltrimethylammonium chloride (60:40 weight % and 80.3:19.7 mole %) co-polymer, intrinsic viscosity of 14 dl/g.

Polymer C: Acrylamide:acryloyloxyethyltrimethylammonium chloride (40:60 weight % and 64.5:35.5 mole %) co-polymer, intrinsic viscosity of 14 dl/g.

Polymer D: Acrylamide:acryloyloxyethyltrimethylammonium chloride (35.5:64.5 weight % and 60:40 mole %) co-polymer, intrinsic viscosity of 7 dl/g.

Polymer E: High molecular weight cationic polyethylenimine (ca 1,000,000 Da).

Polymer F: High molecular weight cationic polyethylenimine (ca 2,000,000 Da).

Polymer G: high molecular weight cationic Polyvinylamine (K value 140), 10% hydrolysed N-vinylformamide homopolymer.

Polymer H: high molecular weight cationic Polyvinylamine (K value 140), 20% hydrolysed N-vinylformamide homopolymer.

Bentonite: Sodium activated bentonite

Unless otherwise stated the polymers of added to the aqueous cellulosic suspension as an aqueous solution.

Example 1

The stock used in the Table 1 consists of non refined virgin bleached beech sulfite fibers with a concentration of 2% at 50° C.

On the fibers suspension, the following polymers will be used, following the vacuum test method.

TABLE 1

| Experiment | Polymers | Dewatering time t1 (s) | Solid content (%) |
|---|---|---|---|
| 1 | Blank | 21 | 25.7 |
| 2 | 0.05% Polymer A | 15 | 26.3 |
| 3 | 0.05% Polymer A + 0.05% Bentonite | 16 | 26.3 |
| 4 | 0.05% Polymer A + 0.1% Bentonite | 14 | 26.5 |
| 5 | 0.05% Polymer A + 0.15% Bentonite | 13 | 26.6 |
| 6 | 0.05% Polymer A + 0.25% Bentonite | 13 | 26.4 |
| 7 | 0.04% Polymer D | 15 | 27.3 |
| 8 | 0.08% Polymer D | 13 | 27.7 |
| 9 | 0.08% Polymer D + 0.1% Bentonite | 15 | 27.2 |

The table 1 examples show the advantage of using the polymer of the invention (Polymer D) in order to improve the dewatering time but also to increase the solid content of the wet fibers pad versus the combination of a cationic polyacrylamide with a bentonite described in the prior art EP 335576.

This improvement will reduce the energy costs to dry the fibrous sheet and will increase the fiber productivity.

Example 2

The stock used in the Table 2 consists of non refined virgin bleached spruce sulfite fibers at a concentration of 1.5% at 56° C.

On the fibers suspension, the following polymers will be used, following the vacuum test method.

TABLE 2

| Experiment | Polymers | Dewatering time t1 (s) | Solid content (%) |
|---|---|---|---|
| 1 | Blank | 20 | 28.9 |
| 2 | 0.012% Polymer E | 16 | 29.0 |
| 3 | 0.025% Polymer E | 15 | 28.9 |
| 4 | 0.037% Polymer E | 16 | 29.1 |
| 5 | 0.02% Polymer B | 14 | 28.9 |
| 6 | 0.04% Polymer B | 13 | 29.2 |
| 7 | 0.06% Polymer B | 13 | 29.0 |
| 8 | 0.012% Polymer G | 15 | 29.2 |
| 9 | 0.025% Polymer G | 14 | 29.7 |
| 10 | 0.037% Polymer G | 14 | 29.4 |
| 11 | 0.02% Polymer D | 13 | 29.3 |
| 12 | 0.04% Polymer D | 12 | 30.0 |
| 13 | 0.06% Polymer D | 11 | 30.1 |

The table 2 shows the superior effect of the Polymer D and Polymer G in vacuum dewatering time and solid fiber pad solid content.

Example 3

The stock used in the Table 3 consists of non refined virgin bleached beech sulfite fibers at a concentration of 2.15% at 57° C.

On the fibers suspension, the following polymers will be used, following the vacuum test method.

TABLE 3

| Experiment | Polymers | Dewatering time t1 (s) | Solid content (%) |
|---|---|---|---|
| 1 | Blank | 22 | 24.9 |
| 2 | 0.02% Polymer E | 19 | 25.4 |
| 3 | 0.04% Polymer E | 17 | 25.7 |
| 4 | 0.014% Polymer F | 21 | 24.9 |
| 5 | 0.028% Polymer F | 20 | 25.0 |
| 6 | 0.04% Polymer B | 19 | 25.0 |
| 7 | 0.08% Polymer B | 17 | 25.3 |
| 8 | 0.04% Polymer C | 16 | 25.0 |
| 9 | 0.08% Polymer C | 17 | 25.3 |
| 10 | 0.04% Polymer D | 17 | 25.9 |
| 11 | 0.08% Polymer D | 12 | 26.5 |

The table 3 shows again the superior effect of the Polymer D in vacuum dewatering time and solid fiber pad solid content.

Example 4

A confidential trial was run on a pulp machine employing sulphite bleached beech wood stock with a cellulosic fibre suspension at a temperature of about 60° C. and a cellulosic fibre concentration of between 2 and 2.5% and operating with a machine speed of 56 m per minute.

The suspension is pumped and dewatered on a long wire to produce a sheet of 3 cm in thickness.

The press section is a combination of a Kombipress and a schuhpress in order to reach a solid content of 54%.

After the press, the fibrous sheet is dried on drying cylinder up to a solid content of 75% to produce a pulp sheet. The basis weight is about 900 g/m$^2$ (675 g/m$^2$ oven dried). The pulp sheet is cut into 1 m square pieces.

Figure 2:
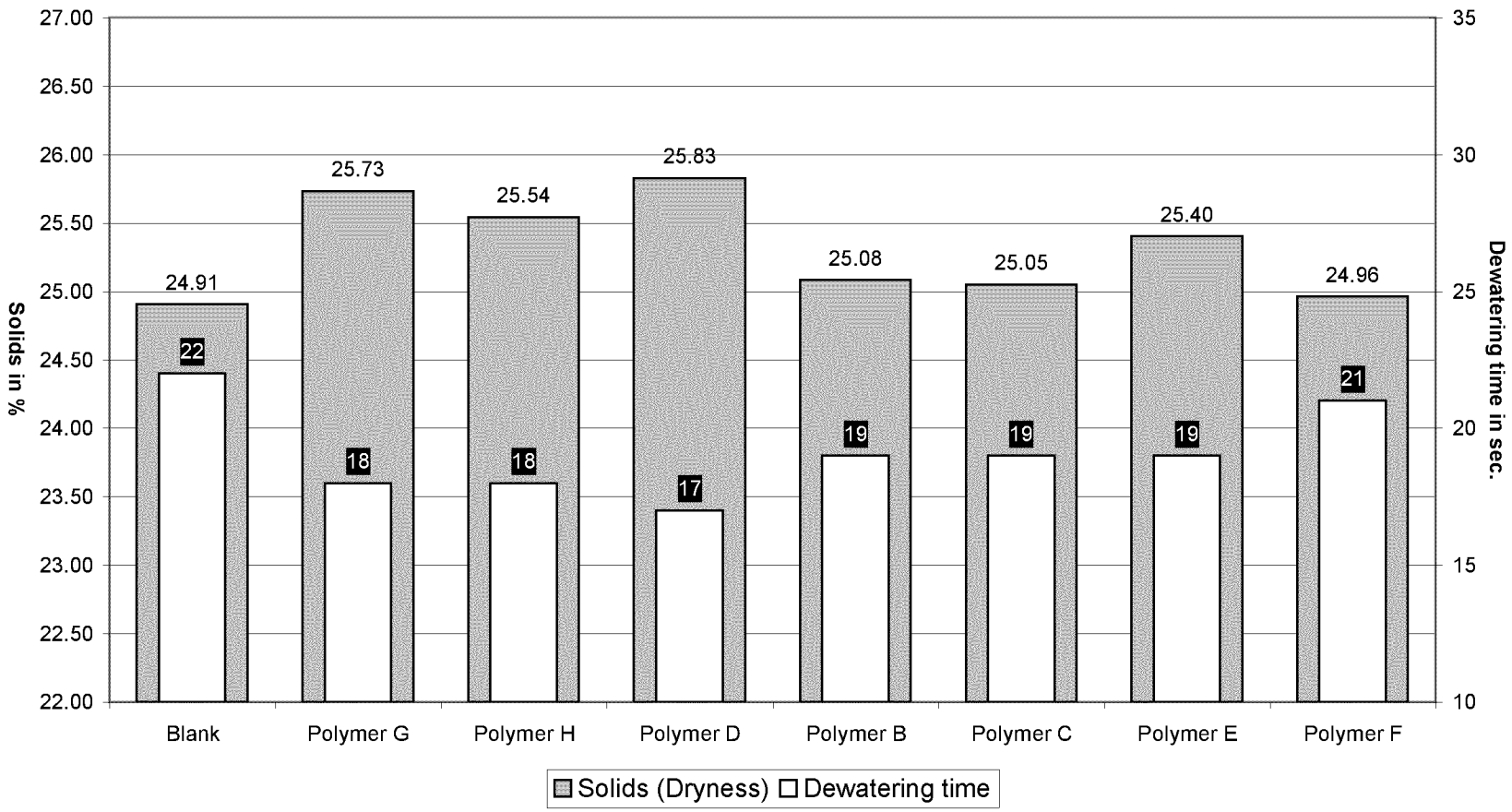

The trial was conducted using a dose of 1000 g per tonne of active polymer based on weight of dry suspension. The dewatering time and the solids of the sheet formed on the machine wire was recorded and shown in FIG. 2.

The results show that polymers of the invention, Polymer D, Polymer G, and Polymer H, provide the best combination of drainage time and solids content of the pulp sheet.

The invention claimed is:

1. A pulp making process comprising:

pulping a fibrous cellulosic material to form an aqueous suspension comprising the cellulosic material, draining the suspension through a screen to form a pulp sheet, and drying the pulp sheet to form a dry market pulp, wherein a water soluble cationic polymer is added to the suspension as a sole drainage aid wherein the water soluble cationic polymer is the only drainage aid added to the suspension in the process, and wherein the water-soluble cationic polymer is:

a copolymer comprising between 1 and 70 mole % (meth) acrylamide and between 30 and 99 mole % (meth)acryloyloxyethyltrimethyl ammonium chloride with an intrinsic viscosity of between 5 and 9 dl/g.

2. The process according to claim 1, wherein the water-soluble cationic polymer is a copolymer comprising between 50 and 70 mole % (meth)acrylamide and between 30 and 50 mole % (meth)acryloyloxyethyltrimethyl ammonium chloride.

3. The process according to claim 1, wherein the water-soluble cationic polymer is the copolymer comprising (meth) acrylamide and (meth)acryloyloxyethyltrimethyl ammonium chloride with an intrinsic viscosity of between 6 and 8 dl/g.

4. The process according to claim 1, wherein the water-soluble cationic polymer is the copolymer comprising between 30 and 70 mole % (meth)acrylamide and between 30 and 70 mole % (meth)acryloyloxyethyltrimethyl ammonium chloride with an intrinsic viscosity of between 5 and 9 dl/g.

5. The process according to claim 1, wherein the polymer is added to the aqueous suspension in an amount between 0.05% and 1.5% based on a dry weight of the suspension.

6. The process according to claim 2, wherein the water-soluble cationic polymer is the copolymer comprising (meth) acrylamide and (meth)acryloyloxyethyltrimethyl ammonium chloride with an intrinsic viscosity of between 6 and 8 dl/g.

7. The process according to claim 2, wherein the polymer is added to the aqueous suspension in an amount between 0.05% and 1.5% based on a dry weight of the suspension.

8. The process according to claim 3, wherein the polymer is added to the aqueous suspension in an amount between 0.05% and 1.5% based on a dry weight of the suspension.

9. The process according to claim 4, wherein the polymer is added to the aqueous suspension in an amount between 0.05% and 1.5% based on a dry weight of the suspension.

* * * * *